United States Patent [19]

Maierson

[11] 4,060,262

[45] Nov. 29, 1977

[54] RECORD MATERIAL

[75] Inventor: Theodore Maierson, Dayton, Ohio

[73] Assignee: The Standard Register Company, Dayton, Ohio

[21] Appl. No.: 669,960

[22] Filed: Mar. 24, 1976

[51] Int. Cl.[2] ..... B41M 5/16; B41M 5/22

[52] U.S. Cl. ..... 282/27.5; 427/150; 427/151; 427/256; 427/288; 428/524; 428/530; 428/914

[58] Field of Search ..... 427/146, 150, 151, 256, 427/288, 153; 282/27.5; 428/195, 199, 206, 207, 211, 307, 323, 326, 327, 511, 512, 524, 526, 530, 537, 913, 914, 411, 476, 486

[56] References Cited

U.S. PATENT DOCUMENTS

| | | | |
|---|---|---|---|
| 3,466,184 | 9/1969 | Miller | 428/195 |
| 3,466,185 | 9/1969 | Taylor | 427/150 |
| 3,681,390 | 8/1972 | Lin | 260/335 |
| 3,732,120 | 5/1973 | Brockett et al. | 260/59 X |
| 3,932,695 | 1/1976 | Davis et al. | 428/531 |
| 3,952,132 | 4/1976 | Kato et al. | 428/341 |

*Primary Examiner*—Thomas J. Herbert, Jr.
*Assistant Examiner*—Bruce H. Hess
*Attorney, Agent, or Firm*—Jacox & Meckstroth

[57] ABSTRACT

A sensitized record sheet for developing useful color in oily, colorless, chromogenic dye-precursor inks applied thereto. Said record sheet is acid-reacting and bears a liquid ink comprising a non-evaporable liquid organic solvent having dissolved therein an acidic phenolic resin and a lower alkyl gallate.

10 Claims, No Drawings

RECORD MATERIAL

BACKGROUND OF THE INVENTION

This invention relates to record sheets bearing an acid-reacting, substantially colorless, liquid ink which is readily applied to record material in order to make sensitized sheets that will develop color in substantially colorless base-reacting chromogenic inks applied thereto.

Acid-reacting sheets which develop color in applied colorless chromogenic inks are known to the art. Such sheets have previously been sensitized by a coating of acidic solid material such as an acid clay or solid particles of acidic phenolic resin.

It is an object of this invention to provide an acid-reacting sensitized record sheet that can be readily made by standard printing operations, such that a printer can prepare the sensitized sheet at will on any record material base without having to stock several different grades and colors of sensitized record sheets that have previously been coated with the sensitizing material. It is a further object of this invention to provide an acid-reacting sensitized record sheet material, the manufacture of which does not involve the evaporation of a volatile organic coating-vehicle or printing-vehicle. It is a further object of this invention to provide an acid-reacting sensitized record sheet without the use of water as a coating vehicle with the attendant problems of drying as well as cockling, buckling and surface roughening that is commonly encountered when a water solution or slurry is applied to a paper surface.

The objects of this invention have been met by the application of an organic liquid solution of an acidic phenol formaldehyde resin and a lower alkyl gallate. The organic liquid solvent material is selected to be non-evaporable so as to remain liquid on the record sheet surface.

The record sheet is preferably paper or other fibrous material such as the so-called plastic papers. When the acid-reacting sensitizing ink of this invention is applied to a fibrous record sheet surface, such as paper, the sensitizing ink soaks into the fibers, remaining liquid and available for color-developing reaction with subsequently applied base-reacting colorless chromogenic inks. The acid-reacting sensitizing ink of this invention is substantially colorless, although some slight color can be tolerated.

The acid-reacting sensitized sheets of this invention are designed for use with colorless chromogenic dye-precursor materials, particularly Crystal Violet Lactone, particularly as encountered in carbonless copy-paper sheets bearing a coating of pressure-rupturable microcapsules each of which contains a droplet of oil having dissolved therein the base-reacting colorless chromogenic material. Such microcapsule-coated record sheets are commonly used in the art, whereby writing pressure on the surface of the record material ruptures the microcapsule wall and expresses the oily droplets of base-reacting colorless chromogenic material for development of color in the writing pattern on the acid-reacting sensitized record sheet surface provided for that purpose. Exemplary of the microcapsule-coated sheets, useful with the acid-reacting sensitized record sheet of this invention, are commercial "NCR PAPER" CB SHEETS, having microcapsular coatings containing oily solution droplets of Crystal Violet Lactone (CVL) and benzoyl leuco methylene blue (BLMB).

When a commercial "NCR PAPER" CB sheet is coupled with the sensitized sheet of this invention, so that the microcapsule-coated surface of the CB sheet is juxtaposed against the sensitized surface of the record sheet of this invention, writing pressure on the uncoated surface of the CB sheet will produce a copy of the writing on the sensitized record sheet of this invention.

The sensitizing ink of this invention can be applied by any and all conventional printing techniques such as letterpress, dry offset, wet offset and rubber plate. The record sheet can be printed so as to sensitize the entire surface of the sheet or so as to selectively sensitize any portion of the record sheet as desired. Application of the sensitizing printing ink of this invention allows for much greater versatility than the sensitizing coatings currently used in the art, which coatings are commonly applied from water systems and are applied on full-width continuous coaters. One acid-reacting sensitized sheet, manufacturable by printing methods, has previously been known to the art in U.S. Pat. No. 3,466,184 which issued on application of Robert E. Miller on Sept. 9, 1969. The latter acid-reacting printed sensitized sheet, however, involves use of volatile solvent so as to leave a coating of solid acid-reacting phenolic material lightly invested on the record material surface. U.S. Pat. No. 3,466,185 which issued on application of John E. G. Taylor on Sept. 9, 1969, represents an improvement of U.S. Pat. No. 3,466,184 but also involves the use of evaporable solvent to leave a solid acid-reacting sensitizing material on the record sheet surface.

The art has apparently previously been limited to solid acid-reacting sensitizing materials, because clays are of necessity solid, and phenolic resins generally do not develop satisfactory color in applied chromogenic oils except in the solid, undiluted state. The color-developing reaction between phenolic resins and chromogenic inks has been envisioned as a solution reaction, wherein the solid phenolic resin material is dissolved in the oil of the chromogenic ink as the instant of use. However, liquid solutions of acid-reacting phenolic resin materials have not been found useful in the art as sensitizing agents because they develop little or no color in applied chromogenic oils.

The instant combination of acidic phenolic resin and lower alkyl gallate in non-evaporable oil solution has been found to overcome this problem, and to yield a satisfactory print with applied base-reacting chromogenic oils giving an intense and satisfactory color development with good fade resistance.

The acid phenolic polymeric materials useful in this invention include oil-soluble phenol aldehyde polymers and phenol acetylene polymers.

Among the phenolic polymers found useful are paraphenyl phenols and aklyl-phenol-acetylene resins, which are soluble in common organic solvents and possess permanent fusibility in the absence of being treated by cross-linking materials. A specific group of useful phenol-aldehyde polymers are members of the type commonly referred to as "novolaks", (as sold by Union Carbide Corp., New York, N.Y.) which are characterized by solubility in common organic solvents and which are, in the absence of cross-linking agents, permanently fusible. Generally, the phenolic polymer material found useful in practicing this invention is characterized by the presence of free hydroxyl groups and the absence of groups such as methylol, which tend to promote infusibility or cross-linking of the polymer, and by their solubility in organic solvent and relative insolubility in aqueous media. Again, obviously, mixtures of these phenolic polymers can be employed.

Resoles, if they are still soluble, may be used, though subject to change in properties upon aging.

A laboratory method useful in the selection of suitable phenolic resins is the determination of the infra-red absorption pattern. It has been found that phenolic resins showing an absorption in the 3200–2500 c.m.$^{-1}$ region (which is indicative of the free hydroxyl groups) and not having an absorption in the 1600–1700 cm.$^{-1}$ region are suitable. The latter absorption region is indicative of the desensitization of the hydroxyl groups and, consequently, makes such groups unavailable for reaction with the chromogenic materials.

The preparation of phenolic formaldehyde polymeric materials for practicing this invention is described in "Industrial and Engineering Chemistry", volume 43, pages 134 to 141, January 1951, and a particular polymer thereof is described in Example 1 of United States Pat. No. 2,052,093, issued to Herbert Honel on Aug. 25, 1936, and the preparation of the phenol-acetylene polymers is described in "Industrial and Engineering Chemistry", volume 41, pages 73 to 77, January, 1949.

The gallate esters useful herein are lower alkyl esters, particularly propyl gallate, but also octyl gallate.

The solvent useful herein must of necessity have a boiling point greater than three hundred degrees (300°) C. and a vapor pressure not to exceed 1 mm. of mercury at one hundred degrees (100°) C. Best results are generally achieved with a blend of solvents. The solvents are selected on the basis of their ability to promote a speedy reaction between the acid-reacting phenolic resin and the base-reacting chromogenic-material and preserve the solubility of all reacting components over a range of temperatures. Blends of an oily sulfonamide and a chlorinated paraffin are preferred for this purpose. Other high-boiling solvents which may be used to manufacture the sensitizing ink of this invention include chlorinated lower-alkyl phosphates, hydrogenated lower-alkyl abietates, lower-alkyl phthalates, lower-alkyl adipates, lower-alkyl phosphates, lower-alkyl glycallates, lower-alkyl sebacates, chlorinated biphenyls, lower-alkyl biphenyls, lower-alkyl biphenyl oxides, and lower-alkyl benzoates.

The invention having been set out above is here exemplified, but not limited, by the following specific examples in which percents represent percents by weight.

EXAMPLE 1

A sensitizing, acid-reacting printing ink was prepared of the following formulation:

| | Range | Preferred |
|---|---|---|
| N-ethyl-o,p-toluenesulfonamide | 10–50% | 35% |
| Chlorinated paraffine oil (50–75% Cl) | 10–50% | 35% |
| Propyl gallate | 0.5–10% | 2% |
| Tertiary butyl phenol formaldehyde condensation product | 1–40% | 28% |

By N-ethyl-o,p-toluenesulfonamide is meant a mixture of N-ethyl-o-toluenesulfonamide, and N-ethyl-p-toluenesulfonamide, such as is commonly encountered in commercial preparations. The mixture sold as "Monsanto Santicizer 8" was used herein. Although more expensive, pure N-ethyl-o-toluenesulfonamide or pure N-ethyl-p-toluenesulfonamide could also be used herein.

Paper sheets were printed by letterpress to give a color-developing, acid-reacting sensitized record sheet, which when coupled with an "NCR PAPER" CB sheet, gave, in response to writing pressure, an intense blue copy of the written indicia which was stable and resistant to fading when exposed to heat and light.

EXAMPLE 2

As in Example 1, a sensitized, acid-reacting record sheet was prepared by printing on paper the following formulation:

| | Range | Preferred |
|---|---|---|
| N-ethyl-o,p-toluenesulfonamide | 10–50% | 35% |
| Hydrogenated methyl abietate | 10–50% | 35% |
| Propyl gallate | 0.5–10% | 2% |
| Tertiary butyl phenol formaldehyde condensation product | 1–40% | 28% |

The sensitized, acid-reacting record sheet produced by printing paper with the above formulation was satisfactory with respect to intensity of print and fade-resistance to heat and light. However, the formulation of Example 1 was slightly better in intensity to the instant formulation.

| | Range | Preferred |
|---|---|---|
| N-ethyl-o,p-toluenesulfonamide | 10–50% | 11.9% |
| Chlorinated paraffine oil (50–75% Cl) | 10–50% | 17.8% |
| Propyl gallate | 0.5–10% | 1.8% |
| Tertiary butyl phenol formaldehyde condensation product | 1–45% | 41.7% |
| Lipophilic pyrogenic silica | 1–4 % | 2.8% |
| Butyl benzoate | 10–35% | 24% |

The formulation set forth above was found to provide, in some applications, better physical characteristics in reduced viscosity with respect to the other formulations.

Although the preferred embodiment of the composition has been described, it will be understood that within the purview of this invention various changes may be made in the form, proportion and ingredients and the combination thereof, which generally stated consist in a composition capable of carrying out the objects set forth, as disclosed and defined by the appended claims.

The invention having thus been described, the following is claimed:

1. A record sheet sensitized with an acidic reactant for developing a color in an oily printing liquid containing a colorless, basic, chromogenic dye-precursor applied thereto by expression of droplets retained by pressure-rupturable wall material located in the sensitized sheet or in an overlying sheet placed against the sensitized sheet, wherein at least one surface of the sensitized sheet bears a substantially colorless, liquid ink comprising an acidic phenolic resin and a lower-alkyl gallate with both the resin and the gallate dissolved in a liquid organic solvent having a boiling point above 300° C and a vapor pressure at 100° C of 1 mm. of mercury or less.

2. The sensitized sheet of claim 1, wherein the phenolic resin is a phenol-formaldehyde resin.

3. The sensitized sheet of claim 2, wherein the liquid ink is about 10–50% of a first organic solvent, about 10–50% of a second organic solvent, about 0.5–10% gallate, and about 1–40% phenolic resin.

4. The sensitized sheet of claim 2, wherein the liquid ink is about 70% organic solvent, about 2% gallate and about 28% phenolic resin.

5. The sensitized sheet of claim 4, wherein the liquid ink includes about 35% of N-ethyl-o,p-toluenesulfonamide as part of the organic solvent, wherein the gallate is propyl gallate and wherin the phenolic resin is a tertiary-butylphenolformaldehyde condensation product.

6. The sensitized sheet of claim 5, wherein the liquid ink further includes about 35% of a second organic solvent selected from the group consisting of chlorinated paraffin oil and hydrogenated methyl abietate.

7. The sensitized sheet of claim 1, wherein the sheet is a paper sheet.

8. The sensitized sheet of claim 1 wherein the liquid ink includes about 1–4% of lipophilic pyrogenic silica and 10–35% butyl benzoate.

9. In a method of making a mark on a record sheet by applying an oily, colorless, basic chromogenic ink to a sensitized surface of the record sheet, the improvement wherein the sensitized surface of the record sheet bears a substantially colorless liquid ink comprising an acidic phenolic resin and a lower-alkyl gallate dissolved in a liquid organic solvent having a boiling point above 300° C and a vapor pressure at 100° C of 1 mm of mercury or less.

10. The method of claim 9 wherein the record sheet is paper and the liquid ink is about 35% N-ethyl-o,p-toluenesulfonamide, about 35% chlorinated paraffin oil, about 28% tertiary-butylphenol-formaldehyde resin and about 2% propyl gallate.

* * * * *